United States Patent [19]

Yamada et al.

[11] Patent Number: 4,690,158

[45] Date of Patent: Sep. 1, 1987

[54] WASHING APPARATUS

[75] Inventors: Yosuke Yamada, Funabashi; Mitsuhiro Oogami, Chiba, both of Japan

[73] Assignee: Daiwa Special Chemical Co., Ltd., Osaka, Japan

[21] Appl. No.: 696,122

[22] Filed: Jan. 29, 1985

[30] Foreign Application Priority Data

Feb. 16, 1984 [JP] Japan ..... 59-28305

[51] Int. Cl.[4] ..... B08B 3/10

[52] U.S. Cl. ..... 134/107; 202/170

[58] Field of Search ..... 134/105, 107, 109, 11, 134/31; 68/15, 18 C, 18 R; 202/170, 186

[56] References Cited

U.S. PATENT DOCUMENTS

| | | | |
|---|---|---|---|
| 2,057,177 | 10/1936 | Wolff | 134/105 X |
| 2,930,349 | 3/1960 | Jones | 202/170 X |
| 3,028,267 | 4/1962 | Edhoffer | 134/105 X |
| 3,078,701 | 2/1963 | Rand | 68/18 C |
| 3,111,952 | 11/1963 | Roehl | 134/105 |
| 3,346,413 | 10/1967 | Lindemann | 134/105 X |
| 3,375,177 | 3/1968 | Rand | 202/170 X |
| 3,461,039 | 8/1969 | Starmer | 202/186 |
| 3,488,260 | 1/1970 | Gilbert | 202/186 X |
| 3,643,475 | 2/1972 | Stevens, Jr. | 68/18 C |
| 3,904,102 | 9/1975 | Chu et al. | 134/107 X |
| 4,404,062 | 9/1983 | Whitehurst | 202/186 X |
| 4,569,727 | 2/1986 | McCord | 202/170 X |

*Primary Examiner*—Harvey C. Hornsby
*Assistant Examiner*—Frankie L. Stinson
*Attorney, Agent, or Firm*—Flynn, Thiel, Boutell & Tanis

[57] ABSTRACT

A wash and dry apparatus by the use of organic solvent which comprises a working bath for holding the organic solvent in the lower space thereof, heating means disposed within the space of the solvent, and cooling means provided in vertically coiling manner in the upper space above the space for the solvent. The upper space is divided into a main chamber surrounded by the cooling means and a cooling chamber outside the cooling means. The cooling chamber is in communication with the main chamber and has a lower temperature than the main chamber. By the provision of the cooling chamber, an article is washed and dried while the organic solvent is substantially completely condensed and recovered.

5 Claims, 6 Drawing Figures

WASHING APPARATUS

FIELD OF THE INVENTION

This invention relates to a washing apparatus, and more particularly, to a wash-and-dry apparatus for washing an article in an organic solvent and immediately drying it.

BACKGROUND OF THE INVENTION:

For instance, metal plating process has been heretofore conducted in the stages (1) to (4) in sequence:

(1) A stage of removing smears or extraneous matter such as oil attached to the surface of an article to be plated (Pre-treatment Stage);

(2) A stage of immersing the article thus cleaned into a plating bath to plate it (Plating Treatment Stage);

(3) A stage of lifting and withdrawing the resulting plated article out of the plating bath and washing it with water (Water-washing Treatment Stage); and (4) A stage of draining or dewatering and drying the plated article thus washed (Drying Stage).

In the stages (1) to (4) above, the pre-treatment stage (1) must be performed so that the extraneous matter on the article for plating may be completely removed without impairing the article. The drying stage (4) must be performed in such a manner that the water content may be dried homogeneously and sufficiently. Such non-uniform drying that non-uniform wet portions or water droplets are left behind on the article should be avoided as far as possible. This is because when the non-uniform wet portions or water droplets are spontaneously evaporated after the drying stage, these adsorb dirt and dust in the air, so that after the spontaneous evaporation spot-like dirt and water deposits are left behind.

Accordingly, in order to conduct washing and drying while fulfilling the above-mentioned conditions, a wash and dry apparatus in which an organic solvent is used instead of water has been adopted. A conventional wash and dry apparatus in which an organic solvent is used will be explained with reference to FIG. 1.

In FIG. 1, a working bath 1 is partitioned, at its bottom and lower zone, into a draining bath 1*a*, a first washing bath 1*b*, a second washing bath 1*c* and a wash and dry bath 1*d*. The draining bath 1*a* contains an organic solvent solution 2 mixed with a surfactant, and the washing baths 1*b*, 1*c* and the wash and dry bath 1*d* contain each an organic solvent 3 free from any additive. A pipe (not shown) is provided so that the organic solvent solution 2 flowed into the draining bath 1a may flow from the bath near the liquid level outwardly. A further pipe is provided so that the organic solvent 3 may flow through the washing bath 1*c* via the pipe from the washing bath 1*b* into the wash and dry bath 1*d*. The organic solvent 3 flowed out of the wash and dry bath 1*d* is purified for recycling.

At the bottom of each of the baths 1*a*, 1*b*, 1*d*, a heater 4 is positioned. These heaters serve to heat the organic solvent solution 2 and the organic solvent 3 to generate gas or vapor 5 of the organic solvent, which fills the chamber inside the working bath 1.

Along the inner side wall of the working bath 1, a cooling pipe 6 is disposed in a coiling manner, and cooling water or cooling gas such as Freon is routed through the cooling pipe. Below the cooling pipe 6, there is provided a gutter 7 for recovering the solvent. The organic solvent gas 5 is condensed upon contact with the cooling pipe 6 to produce liquid droplets which flow down into the solvent recovery gutter 7 and are returned to the washing bath 1*c*. In this way, loss of the organic solvent gas 5 out of the upper opening of the working bath 1 is minimized.

The organic solvent to be used includes for example, trichloroethylene, 1,1,1-trichloroethane, methylene chloride, trichlorofluoroethane, etc.

A sequential process of draining and drying the plated article which was preliminarily washed in water by means of the apparatus of FIG. 1 is performed in the following steps (I) to (IV):

(I) The plated article 8 having water droplets deposited thereon is immersed into the organic solvent solution 2 within the draining bath 1*a*, whereby the water droplets are separated from the plated article by the action of the surface active agent and floated on the liquid level. These water droplets are removed out of the bath along with the organic solvent solution 2. Then, the plated article is lifted and withdrawn from the organic solvent solution 2, drained and dried. Thus, the plated article free from water droplets is obtained.

However, the surface active agent remains attached to the surface of the plated article thus dried and will be removed in the subsequent washing stage which will be explained below.

(II) The plated article after draining is immersed in the organic solvent 3 within the washing bath 1*b* for a while and withdrawn. During immersing, the organic solvent 3 within the washing bath 1*b* is heated to elevated temperatures with the aid of the heater 4, and the surface active agent deposited on the plated article is readily dissolved into it and substantially washed out.

(III) Then, the plated article withdrawn from the washing bath 1*b* is immersed into the next organic solvent 3 within the washing bath 1*c*. Into the washing bath 1*c* is flowed the purified organic solvent 3 from the solvent recovery gutter 7. The plated article is washed with the organic solvent 3 within the bath 1*c* and concurrently, is cooled below the boiling point of the organic solvent. This is because a cooling pipe (not shown) is disposed in the washing bath 1*c*, in which the organic solvent 3 is preliminarily cooled.

(IV) After cooling in the washing bath 1*c*, the plated article 8 lifted and withdrawn from it and is, as shown in FIG. 1 in phantom line, stopped and suspended above the liquid level of the organic solvent 3 in the wash and dry bath 1*d* for a while to be exposed to the organic solvent gas 5 which is at elevated temperatures. The organic solvent gas 5 is condensed on the surface of the plated article which is cooled to produce liquid droplets, and the droplets flow down continuously along the surface of the plated article and drip. In this way, by dripping of the droplets the plated article can be thoroughly washed.

When the plated article reaches gradually the same temperature as the boiling point of the organic solvent, the organic solvent gas 5 is no longer condensed on the surface of the plated article, so that it becomes dry. At this stage of condition, the plated article is lifted upwardly and withdrawn out of the working bath 1.

By a series of the operations above, draining, cleaning and drying of the plated article are thus finished.

In case where a pre-treatment step for removing smears or extraneous matter such as oil attached to the plated article is conducted, the step (I) above is omitted and the step (II) is then the first step. The extraneous matter or smears such as oil can be likewise removed as in the case of surface active agent as described above.

The present inventors, however, have found that the foregoing conventional apparatus has difficulties or defects which will be described below.

That is, the leakage of the organic solvent gas 5 from the upper opening of the working bath 1 can be diminished to a certain degree by condensing and recovering it by the provision of the cooling pipe 6 and recovery gutter 7, but the leak-tight effect is not still satisfactory. Substantial loss of the solvent still occurs, which is not economical and dangerous in that the leaked organic solvent gas 5 may be hazardous to the health of workers.

It is conceivable that this drawback can be eliminated by making the height of the working bath 1 larger or lowering the temperature of the cooling tube 6 thereby to increase the recovery efficiency, but these solutions pose new problems. In case of the former, the work of immersing the plated article 8 and being immersed consecutively into the respective baths will be difficult. In case of the latter, the temperature within the working bath 1 becomes unnecessarily low and as a result, the plated article is too cool in the course of lifting it up above the bath 1*d*, so that immediately when it is withdrawn out of the working bath water vapor in the air will be unsuitably condensed on the cold, plated article. For this reason, in actual practice, the temperature of the cooling pipe 6 can be merely set at the utmost in a range of from 10° to 15° C.

In view of the present state of the art, the present invention has for a primary object to provide a washing apparatus with which leakage of the gas of washing liquid can be decreased to a substantial degree while retaining good working efficiency and washing effect.

SUMMARY OF THE INVENTION

This invention is designed for an improvement in a washing apparatus (particularly, a wash-and-dry apparatus) which comprises a container bath for holding a washing liquid (particularly, an organic solvent as stated above), heating means for heating the washing liquid within the container bath (for example, a heater disposed within the bath) and cooling means for condensing the gas of the washing liquid evolved within the container bath which means is provided within the bath along the side wall thereof (for example, a cooling pipe as mentioned above), the improvement consisting in that a cooling chamber is provided outwardly of the cooling means so as to communicate with the main chamber of the container bath which extends inwardly of the cooling means and that the cooling chamber has a lower temperature than the temperature of the main chamber of the container bath.

BRIEF DESCRIPTION OF THE DRAWINGS

Preferred examples of this invention will be hereinafter described in more detail with reference to the accompanying drawings in which.

DETAILED DESCRIPTION OF THE INVENTION

Figure 1:
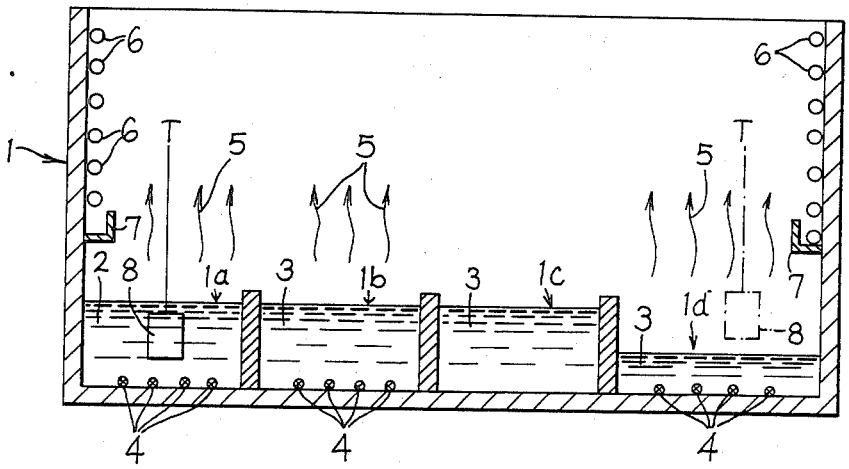
FIG. 1 PRIOR ART
FIG. 1 is a longitudinal sectional view of a prior art washing and drying apparatus.
Figure 2:
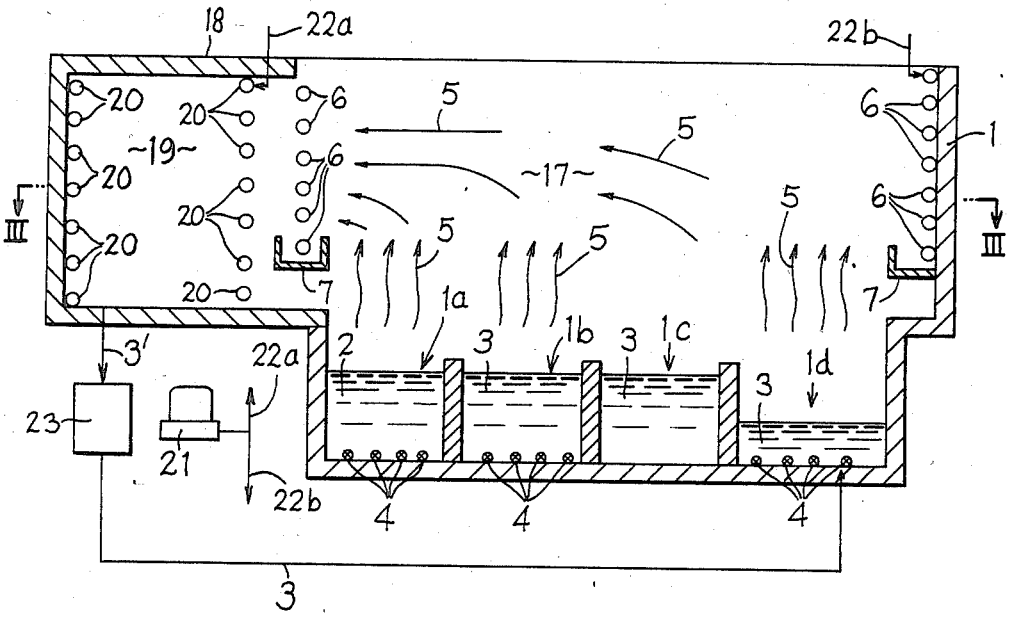
FIG. 2 is a longitudinal sectional view showing one example of a wash-and-dry apparatus according to this invention.
Figure 3:
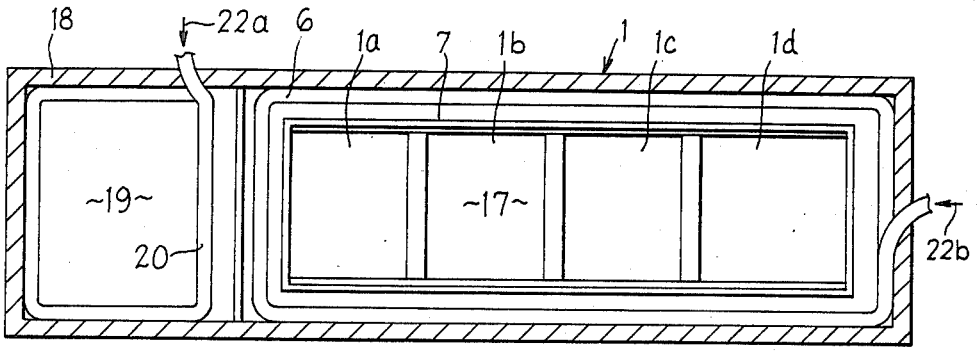
FIG. 3 is a transverse sectional view taken on the line III—III in FIG. 2.
Figure 4:
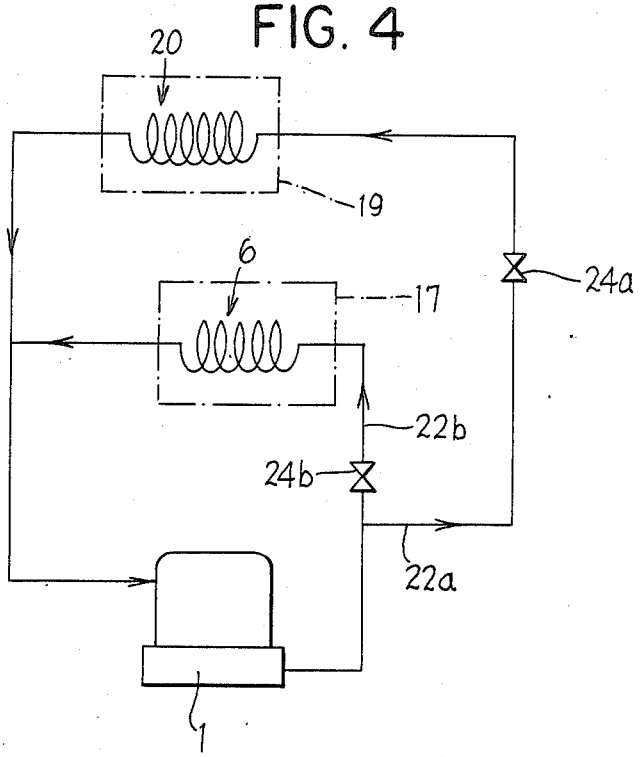
FIG. 4 is a flow diagram showing the feed system of a cooling medium.

FIG. 2 to FIG. 4 illustrate one example of this invention. In FIG. 2 and FIG. 3, the wash and dry apparatus is constructed of a working bath 1 partitioned into a draining bath 1*a* for holding an organic solvent solution 2, washing baths 1*b*, 1*c* for holding an organic solvent 3, a wash and dry bath 1d for holding an organic solvent 3, a heater 4, a cooling pipe 6 and a solvent recovery gutter 7 in a similar manner to the prior art apparatus illustrated in FIG. 1 except that a gas suction bath 18 is installed in side-to-side abutment with the working bath 1. The gas suction bath 18 defines therein a gas suction chamber 19 which is put in communication with a main chamber 17 of the working bath 1 filled with an organic solvent gas 5. In the gas suction bath 18, a cooling pipe 20 is provided in a coiling manner. To the cooling pipe 20 of the gas suction bath 18 and the cooling pipe 6 of the working bath 1, respectively, cooling media 22*a*, 22*b* are admitted which are fed from a common cooling device 21 and branched. The branching amounts of these cooling media are controlled by means of valves 24*a*, 24*b* respectively and fed to the cooling pipes 20, 6 whereby magnitudes of the respective cooling pipes are regulated.

Stated another way, the temperature $T_1$ of the suction chamber 19 is regulated to be lower than the temperature $T_2$ of the main chamber 17 of the working bath 1 constituting the upper half space of the working bath 1. More specifically, the temperture $T_2$ of the upper half space of the working bath 1 is likewise kept to be 0° to 15° C. as in prior art. The temperature $T_2$ is chosen so that the organic solvent gas 5 may be efficiently recovered by means of the cooling pipe 6 while avoiding the problems that the plated article is excessively cooled and as a result, water content or moisture in the air is condensed and deposited on the plated article when it is lifted and withdrawn out of the bath. The temperature $T_1$ of the suction chamber 19 is set to be −10° to 0° C., lower than the temperature $T_2$.

The temperature of the suction chamber 19 is thus made lower, so that a major amount of organic solvent gas 5 is condensed by means of the cooling pipe 20. As a consequence, the concentration of organic solvent gas 5 in the suction chamber 19 is lower than that of the organic solvent gas in the main chamber 17 of the working bath 1. That is, a concentration gradient is created between the working bath 1 of a higher gas concentration and the suction bath 18 of a lower gas concentration. Hence, the organic solvent gas 5 boiling away above the solvent liquid level and filled in the working bath 1 flows toward the suction chamber 19 as shown in the arrow lines and enters it passing through the interstices of the cooling pipe 6. The organic solvent gas 5 thus sucked in the suction chamber 19 is cooled and condensed by means of the cooling pipe 20. The resulting condensed liquid 3' is recovered to a water separator 23 where it is regenerated to the solvent 3 which is in turn sent back to the wash and dry bath 1*d* or the washing bath 1*b* for reuse.

In this manner, by the provision of the gas suction bath 18 as a subsidiary cooling chamber, the organic solvent has 5 is sufficiently prevented from leaking from the upper opening of the working bath 1 and can be efficiently recovered and reused. Thus, the washing and drying operation can be performed efficiently and securely.

It is advantageous that there is no need of making the height of working bath 1 greater and the cooling pipe 6 can be set at a suitable temperature.

In this embodiment as illustrated, the suction bath 18 is positioned in side-to-side abutment with the one short side wall of the working bath 1 (the left hand in FIG. 3), but may be positioned contiguous to the opposite short side wall of it (on the bath 1*d* side) or one or both of the opposite long side walls of it (the upper and/or lower side in FIG. 3).

The suction bath 18 may also be provided so as to surround the whole surrounding wall of the working bath 1.

The construction of the respective baths 1*a*, 1*b*, 1*c*, 1*d* may be varied in various ways. For instance, the second washing bath 1*c* may be equipped with a ultrasonic vibrator for washing.

The manner in which the solvent is flowed into or out of the respective baths is not limited to the manner above, and may be varied.

When smears or extraneous matter such as oil attached to the article for plating are removed in the pre-treatment stage, the process may be commenced from the first washing bath 1*b* without using the draining bath 1*a* or without providing the working bath 1 with the draining bath 1*a*.

Figure 5:
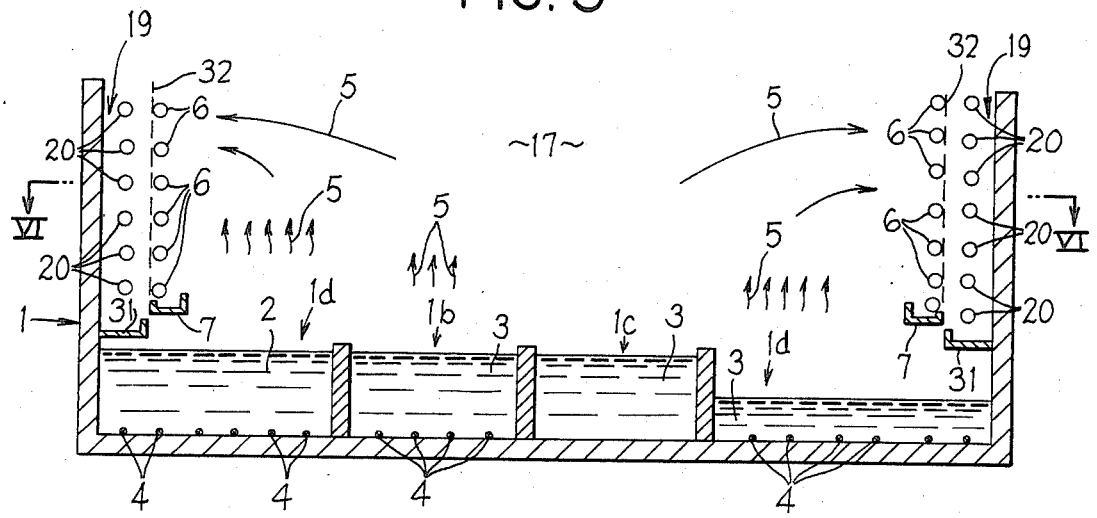
FIG. 5 is a longitudinal sectional view showing another example of a wash-and-dry apparatus according to this invention.
Figure 6:
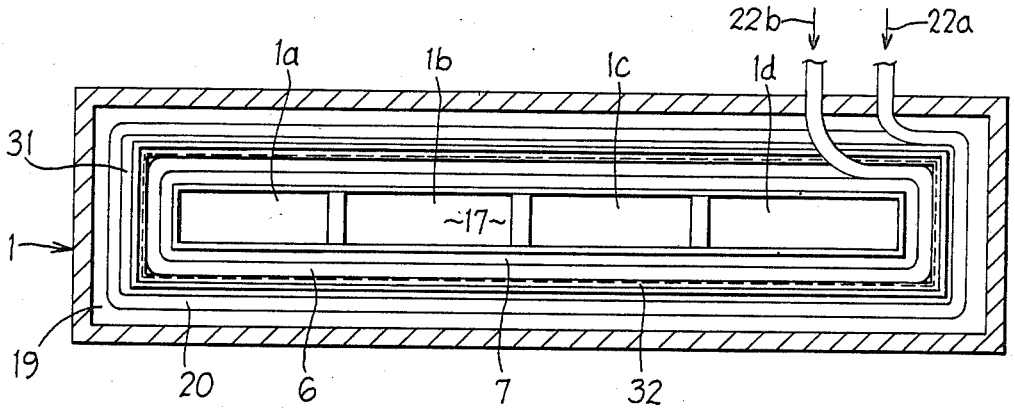
FIG. 6 is a transverse sectional view taken on the line VI—VI in FIG. 5.

FIG. 5 and FIG. 6 illustrate another example of this invention. In this example, the cooling pipe 20 is provided in a coiling manner so as to surround the outer perimeter of the cooling pipe 6 provided in a coiling manner, and between the cooling tubes 6 and 20 there is interposed a reticulate tubular body 32 which serves to hold the cooling tube 6. By this construction, the gas suction chamber 19 and the main chamber 17 of the working bath 1 are put in communication with each other through meshes of the tubular body 32. Below the cooling pipe 20, a solvent recovery gutter 31 is provided.

The other elements than those mentioned above are similar to those in the aforementioned example, except that the cooling device and the water separator are omitted in the figures.

The temperature within the suction chamber 19 is made lower than that within the main chamber 17 of the working bath 1 with the aid of the cooling tube 20.

The organic solvent gas 5 filled within the working bath 1 flows toward the suction chamber 19 likewise in the foregoing first example, whereby it is prevented from leaking and work efficiency is enhanced.

It is advantageous that in this example, the suction chamber 19 is provided within the working bath 1 so as to surround the whole perimeter of the main chamber, so that solvent recovery rate can be enhanced and an existing working bath may be used.

The invention is not limited to the above examples, and may be varied and modified without departing from the spirit and scope of this invention. For instance, the number of treating baths within the working bath 1 may be varied and as the case may be, the wash and dry bath may be omitted. The cooling means and the heating means are not limited to those stated above. The reticulate tubular body 32 used in the second example may be interposed, also in the first example, between the spaces 17 and 19.

All the above examples have been described with the apparatus for washing and drying a plated article, but other articles such as electronics parts may also be applied to the apparatus of this invention.

This invention can be applied to every wash and dry apparatus in which an organic solvent is used, irrespective of the objective article to be washed and dried.

According to the apparatus of this invention shown in FIG. 2, the following advantageous results were obtained by effecting the washing and drying process of plated articles.

Running Conditions:

Solvent: Trichlorotrifluoroethane
Main Chamber, Temperature: 3° C.
(Cooling pipe's temperature: 5° C.)
Cooling Chamber, Temperature: −6° C.
(Cooling pipe's temperature: −15° C.)

For comparison purposes, the conventional apparatus shown in FIG. 1 was operated under the conditions:

Solvent: Trichlorofluoroethane
Main Chamber, Temperature: 8° C.
(Cooling pipe's temperature: 10° C.)

After 8 hours run, solvent loss of the apparatus (FIG. 2) of this invention was less than one fifth the solvent loss of the conventional apparatus (FIG. 1). Thus, with the apparatus of this invention, solvent loss and solvent recovery are much improved over conventional apparatus.

As described above, according to this invention, the cooling space of lower temperature is provided outside the cooling means, so that vapors of the washing liquid, such as an organic solvent is sucked into the cooling space, while producing a concentration gradient of the gas. As a consequence, loss of washing liquid can be diminished greatly because it is prevented from leaking from the upper opening of the bath. Furthermore, the danger of the gas being inhaled by workers is also avoided.

We claim:

1. A washing apparatus for washing and drying articles with a volatile organic washing liquid, which comprises:

an upright vessel having a bottom wall and an upright circumferential wall defining a working bath in the lower portion thereof, partition means dividing said working bath into a plurality of washing baths each adapted to contain a volatile liquid organic solvent, heating means in at least one of said washing baths for vaporizing said solvent, said vessel having an upper main chamber therewithin above said washing baths for receiving vapor of said solvent from said washing baths;

a first condenser coil facing said upper main chamber and defining the perimeter thereof, said first condenser coil being arranged so that the convolutions of said first condenser coil form a vertical array with interstices being provided between adjacent convolutions of said first condenser coil, said vessel having wall means defining a suction chamber which extends horizontally outwardly from said upper main chamber at the same vertical height as said first condenser coil, said suction chamber being open along the horizontally inner side thereof whereby vapor of said solvent can flow through the interstices between adjacent convolutions of said first condenser coil and thence into said suction chamber;

a second condenser coil disposed in said suction chamber at the same vertical height as and horizontally outwardly offset from said first condenser coil, said second condenser coil being arranged so that the convolutions of said second condenser coil form a vertical array, corresponding portions of the convolutions of said second condenser coil being spaced horizontally outwardly from, in parallel with and being directly opposed to corresponding portions of the convolutions of said first condenser coil so that the vapor of said solvent that flows into said suction chamber flows in contact with said second condenser coil; and cooling means connected for receiving coolant discharged from said first and second condenser coils, then cooling said coolant and then separately returning different portions of said coolant to said first and second condenser coils to maintain the temperature in said suction chamber lower than the temperature in said upper main chamber, whereby the solvent vapor evolved from said working bath is substantially completely condensed in said upper main chamber and said suction chamber.

2. A washing apparatus as claimed in claim 1 wherein said suction chamber and said upper main chamber are disposed in side-by-side relation with each other, said chambers being in communication with each other through the interstices of said first condenser coil, and corresponding portions of said first and second condenser coils are disposed in side-by-side relation with each other.

3. A washing apparatus as claimed in claim 1 wherein said suction chamber is disposed outside said upper main chamber so as to surround the whole outer perimeter of said upper main chamber, and said first condenser coil is held around the outer perimeter of said upper main chamber by a reticulate tubular body which permits communication between said chambers.

4. A washing apparatus as claimed in claim 1 wherein said vapor condensed in said suction cooling chamber is recovered for reuse in said washing liquid baths.

5. A washing apparatus for washing and drying articles with a volatile organic washing liquid, which comprises:

an upright, open-top vessel having a bottom wall and an upright circumferential wall defining a working bath in the lower portion thereof, partition means dividing said working bath into a plurality of washing baths each adapted to contain a volatile liquid organic solvent, heating means in at least one of said washing liquid baths for vaporizing said solvent, said vessel having an upper main chamber therewithin above said washing liquid baths for receiving vapor of said solvent from said washing liquid baths;

first and second cooling pipe means adapted to receive flows of coolant therethrough, said first and second cooling pipe means each being arranged in the form of a coil which lies in a vertical plane with interstices being provided between adjacent convolutions of each coil, said first and second cooling pipe means being disposed adjacent to said circumferential wall of said vessel in the upper portion thereof, said first cooling pipe means facing said upper main chamber and defining the perimeter thereof, said second cooling pipe means being at the same vertical height as, being laterally outwardly spaced from and being opposed to said first cooling pipe means, a cooling chamber defined by and between said first and second cooling pipe means, said cooling chamber being in communication with said upper main chamber of said vessel through the interstices of said first cooling pipe means for receiving said solvent vapor from said upper main chamber after it has passed over said first cooling pipe means;

means for supplying first and second streams of the same coolant to said first and second cooling pipe means so that said cooling chamber has a lower temperature than said upper main chamber whereby a portion of said solvent vapor condenses by contact with said first cooling pipe means and a further portion of said solvent vapor condenses in said cooling chamber by contact with said second cooling pipe means and the concentration of said solvent vapor in said cooling chamber is lower than the concentration of said solvent vapor in said upper main chamber above said washing liquid baths so as to cause said solvent vapor to flow from said main chamber into said cooling chamber solely due to the difference of concentration of the solvent vapor.

* * * * *